US006422195B1

(12) United States Patent
Powell

(10) Patent No.: US 6,422,195 B1
(45) Date of Patent: Jul. 23, 2002

(54) ACCESSORY DRIVE ASSEMBLY

(75) Inventor: Jeffrey Joseph Powell, Belle River (CA)

(73) Assignee: Siemens VDO Automotive, Inc., Tillbury (CA)

( * ) Notice: Subject to any disclaimer, the term of this patent is extended or adjusted under 35 U.S.C. 154(b) by 0 days.

(21) Appl. No.: 09/689,108

(22) Filed: Oct. 12, 2000

Related U.S. Application Data

(60) Provisional application No. 60/159,851, filed on Oct. 15, 1999.

(51) Int. Cl.[7] ..... F02B 77/00
(52) U.S. Cl. ..... 123/198 C; 417/201
(58) Field of Search ..... 123/41.44, 198 R, 123/198 C; 417/201

(56) References Cited

U.S. PATENT DOCUMENTS 4,662,320 A * 5/1987 Moriya ..... 123/41.44
6,241,481 B1 * 6/2001 Keyes et al. ..... 417/201

* cited by examiner

*Primary Examiner*—Noah P. Kamen

(57) ABSTRACT

An accessory drive assembly is provided for a vehicle and includes housing having first and second chambers for first and second accessory drive components, respectively. The first and second accessory drive components may be a water pump and steering pump, a water pump and alternator, or some other combination of accessory drive components. First and second driven elements are disposed within the first and second chambers, respectively. The driven elements correspond appropriately to the accessory drive component. That is, the driven element for a water pump may be an impeller, and a driven element for a power steering pump may be a gerotor assembly. A common driveshaft is supported in the housing and is coupled to the first and second driven elements. In an alternative embodiment of the present invention, the housing may be a rocker cover. The rocker cover includes a chamber formed therein for an accessory drive component such as a water pump. A driven element is disposed within the chamber and a driveshaft is supported by the rocker cover housing and is coupled to the driven element.

19 Claims, 2 Drawing Sheets

ACCESSORY DRIVE ASSEMBLY

RELATED APPLICATIONS

This application claims priority to U.S. Provisional Application No. 60/159,851 filed on Oct. 15, 1999.

BACKGROUND OF THE INVENTION

This invention relates to an accessory drive assembly for use with an internal combustion engine, and more particularly, the invention relates to an accessory drive assembly including multiple accessory drive components such as a water pump, power steering pump and/or, or alternator.

Accessory drive components are used in vehicles to provide fluid, electrical or other power for accessory systems. The accessory drive components are typically secured to an internal combustion engine by brackets and driven by belts and pulleys that are coupled to the engine's crankshaft. Accessory drive components include water pumps, alternators, power steering pumps, air pumps, and air conditioning compressors. The accessory drive components have separate housings that are individually supported on the engine by brackets. Each accessory drive component includes a driveshaft coupled to a drive element which is driven by a drive pulley. The drive element produces power for the accessory drive systems one or more belts connect the pulleys of all the accessory drive components together to the engine's crankshaft. Because the accessory drive components are secured to the engine separately, the components require more space in the vehicle's engine compartment. More parts are also required because each accessory drive component has its own housing, driveshaft, and fasteners and brackets that are used to secure the component to the engine. Therefore, what is needed is an accessory drive assembly which incorporates two or more accessory drive components so that parts may be shared between the accessory drive components and the space required in the engine compartment may be reduced.

SUMMARY OF THE INVENTION AND ADVANTAGES

The present invention provides an accessory drive assembly for a vehicle including a housing having first and second chambers for first and second accessory drive components, respectively. The first and second accessory drive components may be a water pump and steering pump, a water pump and alternator, or some other combination of accessory drive components. First and second driven elements are disposed within the first and second chambers, respectively. The driven elements correspond appropriately to the accessory drive component. That is, the driven element for a water pump may be an impeller, and a driven element for a power steering pump may be a gerotor assembly. A common driveshaft is supported in the housing and is coupled to the first and second driven elements. In an alternative embodiment of the present invention, the housing may be a rocker cover. The rocker cover includes a chamber formed therein for an accessory drive component such as a water pump. A driven element is disposed within the chamber and a driveshaft is supported by the rocker cover housing and is coupled to the driven element.

In this manner, the present invention utilizes a common housing and driveshaft for multiple accessory drive components. Accordingly, the present invention provides an accessory drive assembly which incorporates two or more accessory drive components so that parts may be shared between the accessory drive components and the space required in the engine compartment may be reduced.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
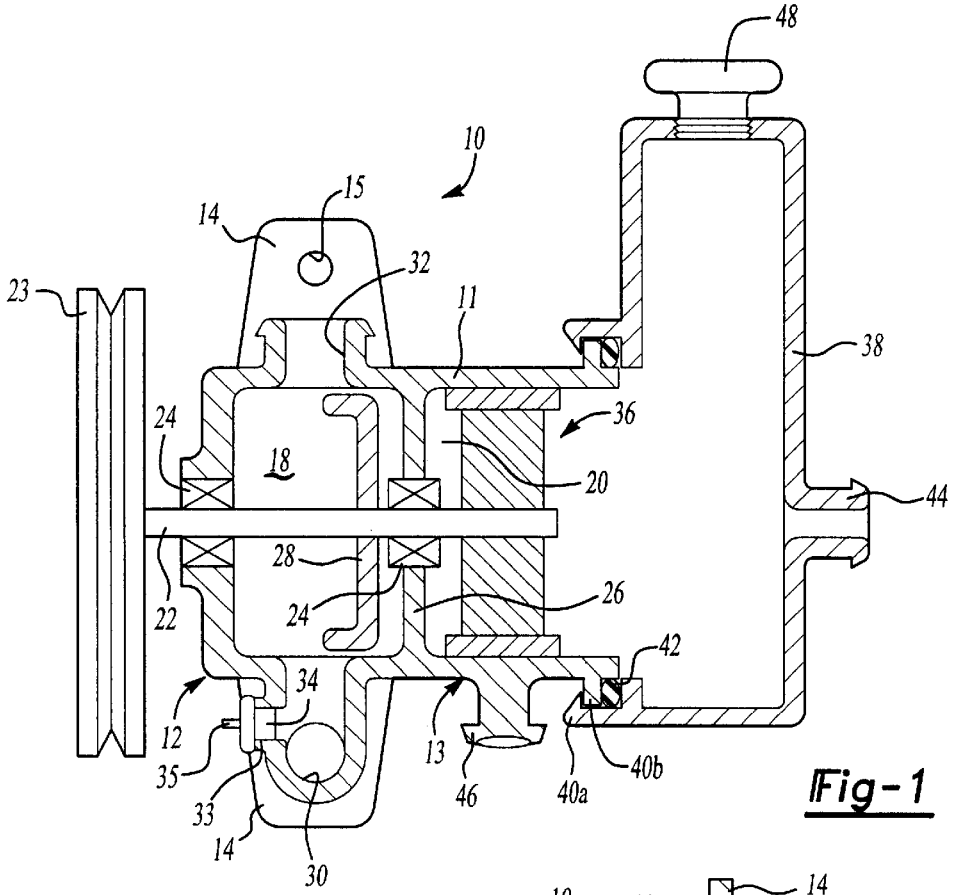
FIG. 1 is a cross-sectional view of an embodiment of the present invention accessory drive assembly.

An embodiment of an accessory drive assembly 10 of the present invention is shown in FIG. 1. The accessory drive assembly 10 has a common housing 11 for a first accessory drive component 12 and a second accessory drive component 13. In the embodiment shown in FIG. 1, the first accessory drive component 12 is a water pump, and the second accessory drive component 13 is a power steering pump. The housing 11 includes flanges 14 having apertures 15 for receiving fasteners (not shown) for securing the accessory drive assembly 10 to an appropriate mounting structure such as an engine.

The housing 11 defines a first chamber 18 and a second chamber 20 separated by an intermediate wall 26. A driveshaft 22 is supported in the housing 11 by bearings 24. In particular, the intermediate wall 26 may include a hole 25 for supporting bearings 24 and the driveshaft 22. The driveshaft 22 has an end extending from the housing 11 that may be secured to a pulley 23 for receiving rotational drive from a belt that is connected to the engine's crankshaft. However, it is to be understood that the driveshaft 22 may be driven by other means such as an electric motor. Coolant is pumped through the chamber 18 from an input 30 through an output 32 by an impeller 28 that is secured to the driveshaft 22. Preferably, the impeller 28 is molded onto the driveshaft 22.

The housing 11 may include a thermostat housing portion 33 in fluid communication with the input 30 for receiving a thermostat 34. In this manner, the thermostat may be incorporated into the accessory drive assembly 10. The housing 11 may also include a temperature sensor 35 supported therein for sensing the temperature of the coolant and further integrating components into the accessory drive assembly 10. Hoses are secured to the input 30 and output 32, as is known in the art, for carrying the coolant from the water pump 12 to the engine components.

The power steering pump 13 is also received in the housing 11. A gerotor assembly 36 is supported on the driveshaft 22 for pumping power steering fluid to the rack and pinion assembly for assisting the driver in steering the vehicle. The second fluid chamber 20 includes an output 46. A power steering fluid reservoir 38 is secured over an opening in the housing 11 to provide the needed fluid to the gerotor assembly 36 for pumping to the power steering components. Reservoir 38 includes an input or return 44. The reservoir 38 may be secured to the housing 11 by interlocking members 40*a*, 40*b* and sealed against one another by seal 42. The reservoir 38 includes a removable fill cap 48 threadingly received by a portion of the reservoir 38.

To facilitate assembly of the accessory drive assembly 10 the housing 11 may include openings to permit the insertion of the driven elements, such as the gerotor assembly 36. The water pump 12 may also include an opening that is later closed by an end cap. For example, the chamber 20 of the housing 11 is closed by reservoir 38. Alternatively, the housing 11 may be formed from halves that are secured together by fasteners, welding, or other means. Preferably, the housing 11 is constructed from a plastic material, and the chambers 18, 20 are formed using a lost core process. An end cap 50 is secured over an opening in the housing 11 to close the chamber once a component of the accessory drive assembly 10 is inserted into the housing 11, such as the impeller 28 of the water pump 12, as shown in FIG. 2.

Figure 2:
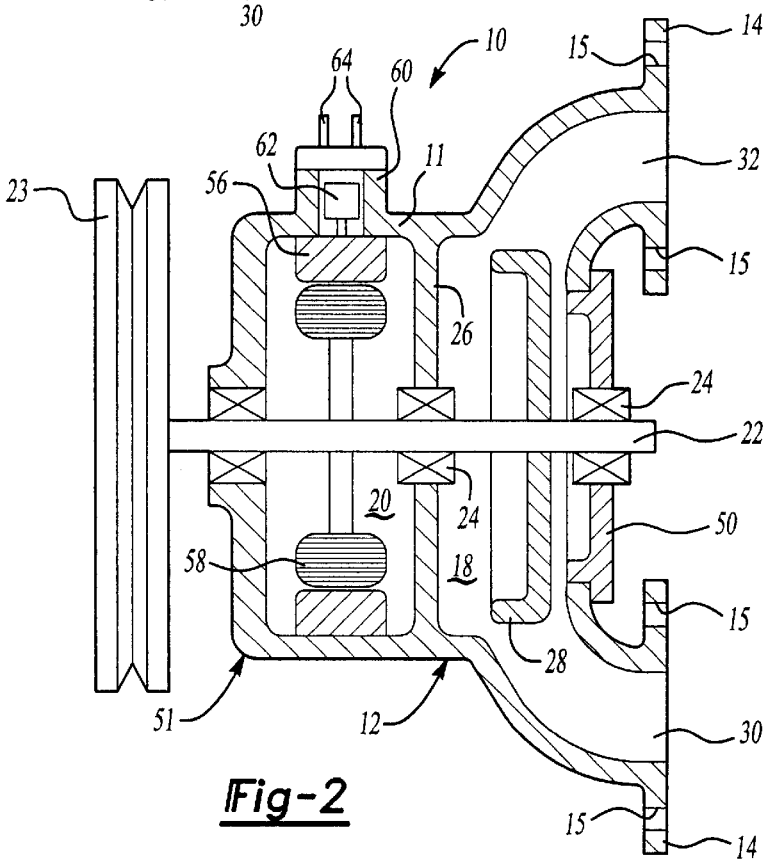
FIG. 2 is a cross-sectional view of another embodiment of the present invention accessory drive assembly.

Another embodiment of the present invention accessory drive assembly 10 is shown in FIG. 2. The accessory drive assembly 10 includes a water pump 12 that may be secured to the front of an engine block as is commonly done with prior art engine assemblies. In addition to having the water pump 12, the accessory drive assembly 10 includes an accessory drive component 51 such as a alternator. The alternator 51 includes permanent magnets 56 that are disposed within the chamber 20. Coils 58 are supported on the driveshaft 22. A current is generated in the coils 58 as the coils 58 are rotated by the driveshaft 22 adjacent to the permanent magnets 56. The housing 11 may also include a voltage regulator housing portion 60 for receiving a voltage regulator 62. In this manner, additional components of the alternator may be incorporated into the accessory drive assembly 10 thereby further reducing accessory drive components that are separately secured to the engine or vehicle. Connectors 64 may be molded into the housing 11.

Figure 3:
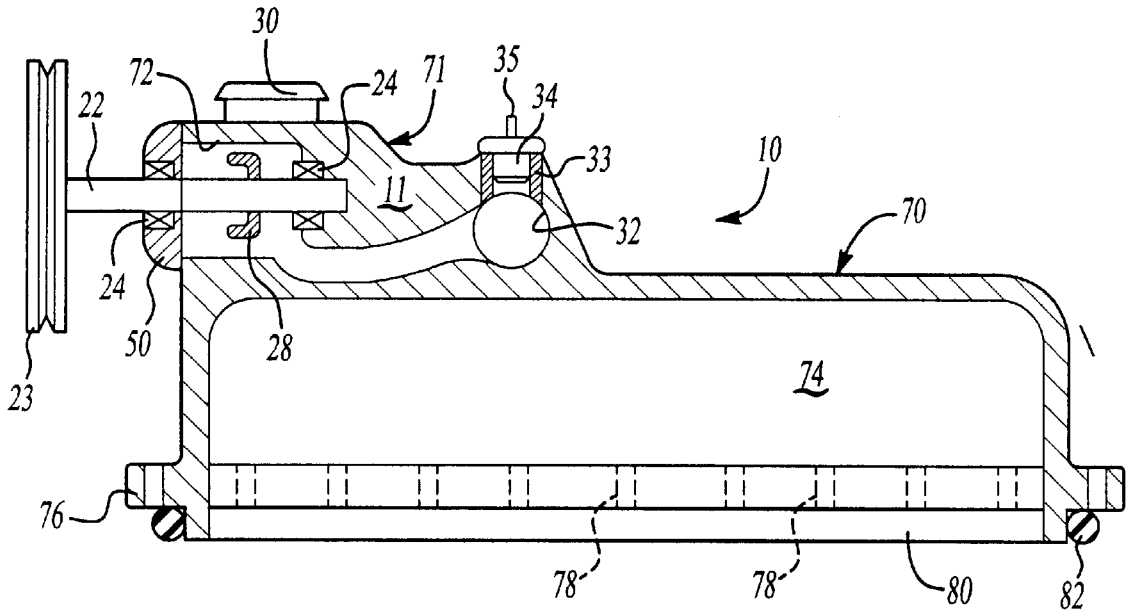
FIG. 3 is a cross-sectional view of yet another embodiment of the present invention accessory drive assembly.
Figure 4:
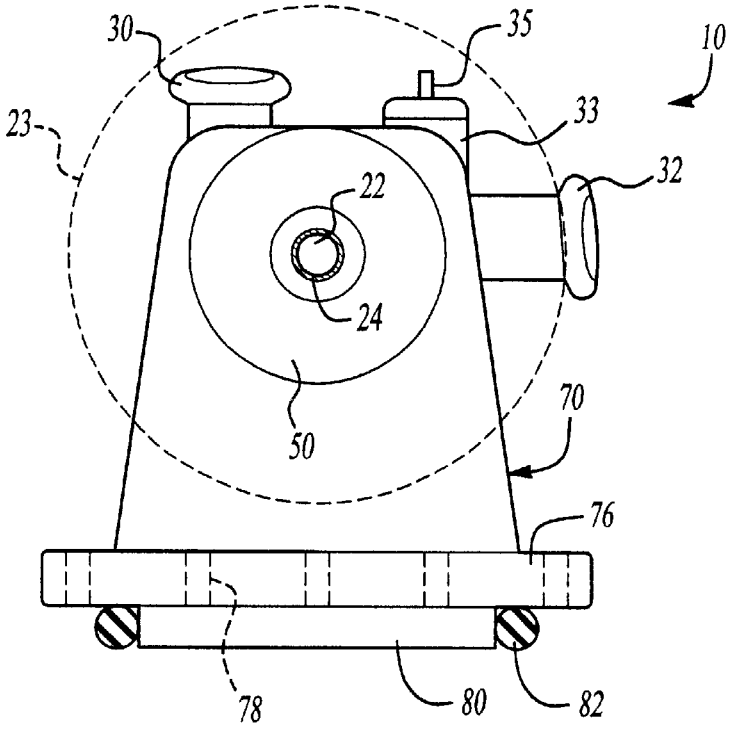
FIG. 4 is a front elevational view of the embodiment shown in FIG. 3.

FIG. 3 and 4 depict another embodiment of the present invention. In this embodiment, the housing 11 forms a rocker cover 70. An accessory drive component 71, such as a water pump, is integrated into the rocker cover 70. A chamber 72 is formed in the rocker cover 70 on a side opposite a cavity 74. The cavity 74 covers such engine components as rocker arms, intake and exhaust valves, and springs. As is known in the art, the rocker cover 70 includes a flange 76 with a plurality of apertures 78 for receiving fasteners (not shown) that secure the rocker cover 70 to the engine cylinder head. A lip 70 extends from the flange 76 to locate the rocker cover 70 relative to the cylinder head. A seal 82 is disposed between the flange 76 and the cylinder head for sealing the two relative to one another. An end cap 50 may be secured to the front of the housing 11 after the driveshaft 22 and impeller 28 have been inserted into the chamber 72. The water pump 71 may extend along the entire length of the top portion of the rocker cover 70, or only a portion of it as shown in FIG. 3. By extending the water pump 71 along the entire length of the rocker cover 70, sound from the valve train may be dampened by the additional housing material and fluid in the water pump 71. The housing 11 of the rocker cover 70 may be formed from a nylon 66, that is reinforced with glass fibers, or any other suitable material.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. An accessory drive assembly for a vehicle comprising:

a housing having first and second chambers for first and second accessory drive components, respectively, wherein said housing is a substantially unitary structure, and said housing includes an intermediate wall separating said first and second chambers;

first and second driven elements disposed within first and second chambers, respectively; and a drive shaft supported in said housing coupled to said first and second driven elements.

2. The accessory drive assembly according to claim 1, wherein said first and second driven elements are supported on said shaft.

3. The accessory drive assembly according to claim 1, further including a pulley supported on an end of said shaft for receiving rotational drive from a drive belt.

4. The accessory drive assembly according to claim 1, wherein said housing is a substantially unitary structure, and said housing includes an intermediate wall separating said first and second chambers.

5. The accessory drive assembly according to claim 1, wherein said first accessory drive component is a water pump, and said first chamber is a coolant chamber having a fluid inlet and a fluid outlet.

6. The accessory drive assembly according to claim 5, wherein said first driven element is an impeller molded onto said drive shaft.

7. The accessory drive assembly according to claim 5, wherein said housing includes a thermostat housing portion with a thermostat disposed therein.

8. The accessory drive assembly according to claim 1, wherein said second accessory drive component is a power steering pump, and said second chamber is a power steering fluid chamber having a fluid inlet and a fluid outlet.

9. The accessory drive assembly according to claim 8, wherein said second drive element is a gerotor coupled to said drive shaft.

10. The accessory drive assembly according to claim 1, further including a bearing received within a hole in said intermediate wall, said bearing supporting said drive shaft.

11. The accessory drive assembly according to claim 1, wherein said housing is constructed from plastic.

12. The accessory drive assembly according to claim 1, wherein said housing includes apertures for receiving fasteners that secure said housing to an internal combustion engine.

13. The accessory drive assembly according to claim 1, wherein said second accessory drive component is an alternator, and said second chamber includes a permanent magnet disposed therein.

14. The accessory drive assembly according to claim 13, wherein said second driven element including at least one wire coil supported on said shaft.

15. The accessory drive assembly according to claim 13, wherein said housing includes a voltage regulator housing portion with a voltage regulator disposed therein.

16. An accessory drive assembly for a vehicle comprising:

a housing having first and second chambers for first and second accessory drive components, respectively, wherein said second accessory drive component is a power steering pump, and said second chamber is a power steering fluid chamber having a fluid inlet and a fluid outlet;

first and second driven elements disposed within first and second chambers, respectively;

a drive shaft supported in said housing coupled to said first and second driven elements; and wherein said power steering pump includes a reservoir supported by said housing and in fluid communication with said fluid inlet.

17. The accessory drive assembly according to claim 16, wherein said reservoir and said housing are secured in a snap-fit relationship.

18. An accessory drive assembly for a vehicle comprising:

a housing having first and second chambers for first and second accessory drive components, respectively;

first and second driven elements disposed within first and second chambers, respectively; and a drive shaft supported in said housing coupled to said first and second driven elements; and wherein said housing includes an opening into said second chamber for receiving said second driven element, and said accessory drive assembly further includes an end cap received in said opening for closing said second chamber.

19. The accessory drive assembly according to claim 18, wherein said second accessory drive component is a power steering pump, and said end cap is a reservoir.

* * * * *